United States Patent [19]

Maher

[11] 3,936,252

[45] Feb. 3, 1976

[54] STEAM PROPULSION SYSTEM

[75] Inventor: William A. Maher, Sepulveda, Calif.

[73] Assignee: Wilma Ryan, Arlington Heights, Ill.

[22] Filed: June 13, 1974

[21] Appl. No.: 479,041

Related U.S. Application Data

[62] Division of Ser. No. 165,987, July 26, 1971, Pat. No. 3,820,335.

[52] U.S. Cl. ..... 418/173; 418/177; 418/261

[51] Int. Cl.[2] ..... F04C 1/00

[58] Field of Search ..... 418/173, 172, 177, 261

[56] References Cited

UNITED STATES PATENTS

| | | | |
|---|---|---|---|
| 775,632 | 11/1904 | Norden | 418/261 |
| 2,907,307 | 10/1959 | Striegl | 418/177 |
| 2,969,743 | 1/1961 | Menon | 418/173 |
| 3,539,281 | 11/1970 | Kramer | 418/173 |

*Primary Examiner*—C. J. Husar

*Attorney, Agent, or Firm*—Sanford Astor

[57] ABSTRACT

The invention relates to a system for propulsion utilizing a vapor heat transfer generator to create high pressure steam directly from water vapor which is transferred to rotary cylinder motors of positive displacement design, which are run on ball and roller bearings to eliminate friction facilitating high speed operation.

3 Claims, 8 Drawing Figures

STEAM PROPULSION SYSTEM

This is a division of application Ser. No. 165,987, filed July 26, 1971 now U.S. Pat. No. 3,820,335.

BACKGROUND OF THE INVENTION

Present propulsion systems for automobiles as well as other means of movement are plagued with difficulties. The present internal combustion engine utilizes a carburetor which must be constantly cleaned and adjusted, an ignition system that must be constantly replaced, a transmission that needs adjustment and often replacement and brakes that must be relined often.

Furthermore, the high output of exhaust products including carbon monoxide and unburned hydrocarbons has caused an atmospheric pollution problem that has already reached the danger level.

It is an object of the present invention to develop a smog-free propulsion system, low in cost, free from service and replacement of parts, and light in weight.

It is a further object of this invention to provide a high pressure steam propulsion system that can be utilized for automobile travel and other means of propulsion.

The system of the present invention utilizes no carburetor, no spark plugs, points or distributor, no crank case, transmission or differential oil, no transmission, no drive shaft, no rear axle or differential and no separate brake system requiring adjustment or replacement.

The system of the present invention utilizes high pressure steam, is light in weight, low in cost and is smogfree.

The system further is far less noisy than the traditional internal combustion engine as power is from a continuous flow of steam rather than an explosion or pulsation and the fuel is non-explosive.

BRIEF DESCRIPTION OF THE DRAWINGS

Referring now to FIG. 1, there is shown a schematic of the steam flow wherein the flow from the steam supply 10 passes through a throttle valve 12 to a four-way reverse valve 14 and then to the motor or motors 16.

Referring to FIG. 2 there is shown the steam generation system. Turning on the ignition switch (not shown) starts the burner motor 18, the igniter 20, and the fuel solenoid 19. This heats the generator 21. When the temperature reaches a predetermined level, for example 350° F., the thermal switch 22 turns on the starter motor 24, and also the water solenoid 26 shown in FIG. 3.

Figure 2:
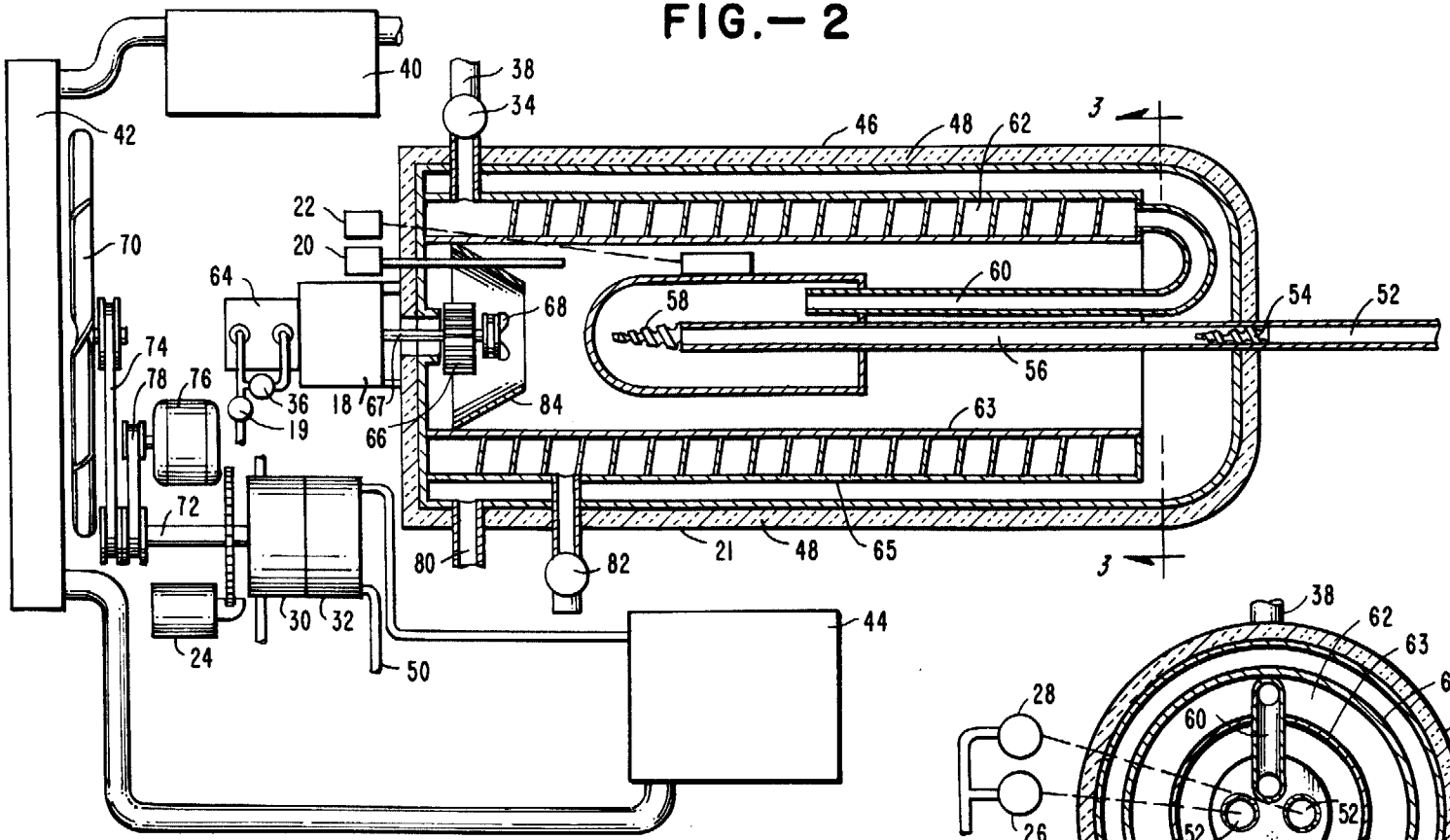
FIG. 2 is a side elevation of the steam production system of the present invention.

This pumps water vapor into the generator 21 building steam pressure. When the pressure reaches a predetermined level, for example 200 psi, a pressure switch (not shown) turns off the starter motor 24 and opens a second solenoid 28 and steam motor 30 takes over the operation of pump 32 during the further operation of the system.

When the pressure reaches a further predetermined level, for example 310 psi, pressure switch 34 closes solenoid 28 reducing pressure and temperature and regulates the pressure at operating conditions between 295 psi and 310 psi for example, by opening and closing solenoid 28.

When the maximum operating temperature, 500° F. for example, is reached temperature switch 22 opens fuel bypass solenoid 36 reducing the fuel volume and temperature and turns on and off solenoid 36 to maintain the operating temperature in operating limits such as 475° F. to 500° F. The operation is fully automatic.

Figure 1:
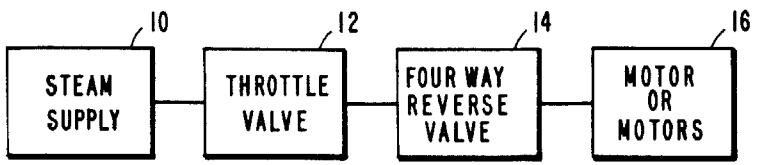
FIG. 1 is a schematic diagram showing the flow of steam through the system.
Figure 5:
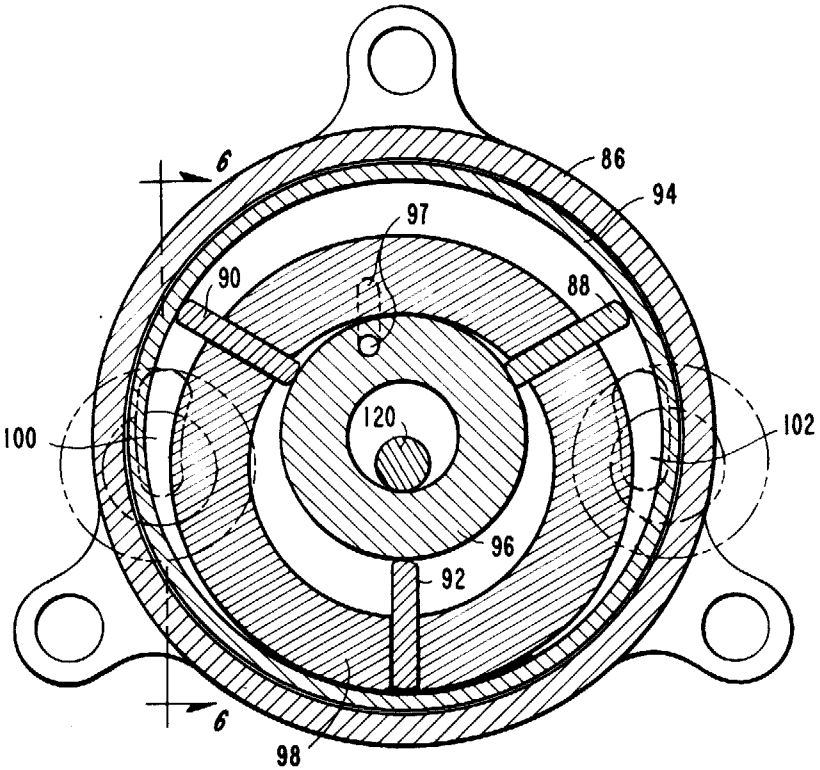
FIG. 5 is a cross-sectional view of the motor of the system taken on lines 5—5 of FIG. 4.
Figure 4:
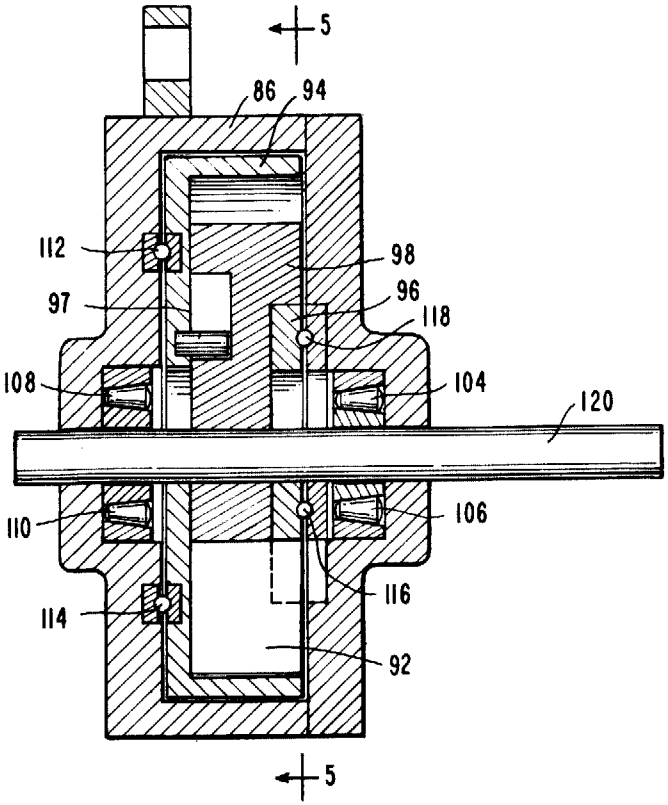
FIG. 4 is a cross-sectional view of the motor of the system taken through its center line.

When the system reaches full power, pressure and temperature, steam will flow from steam supply line 38 to the throttle valve 12 as shown in FIG. 1, through four-way reverse valve 14 to the motor or motors 16 and return to the surge tank 40. The steam will then travel to the condenser 42 and back to the hot well 44.

Figure 3:
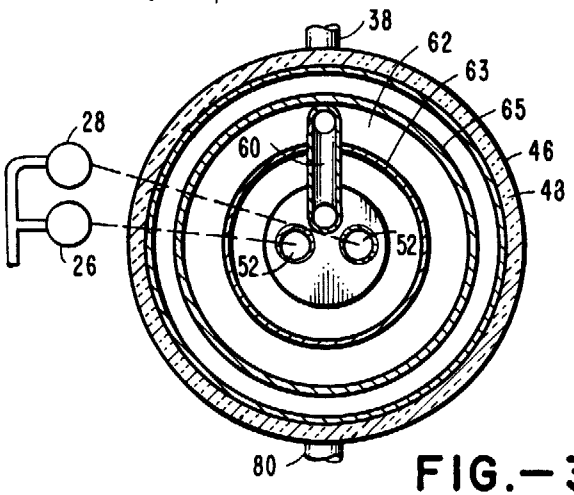
FIG. 3 is a cross-section taken on lines 3—3 of FIG. 2.

Referring also to FIG. 3, the generator 21 consists of an outer shell 46 with insulation 48. Water exits from the water supply pump 32 via supply line 50 and enters the generator 21 through dual entry lines 52. The water passes through fog nozzles 54 into a central feed line 56 into a second fog nozzle 58. By passing through the fog nozzles in this manner the water is in the form of water vapor more easily converted to steam. Dual entry lines and fog nozzles are provided, as shown in FIG. 3, to provide a greater volume of water vapor.

Water vapor usage rather than water liquid allows the radiating surfaces to be increased in temperature to 550° F. to allow for greater volume of heat transfer than prevails in a water tube boiler. Water is an insulating medium that prevents the temperature of the heat transfer surfaces from rising above 250° F. whereas this generator does not utilize water allowing the greater heat radiation. Having no water in the generator at the start, metal surfaces heat very rapidly and there is therefore a short heat-up period, after which steam is generated instantly.

The vapor then passes into an entry tube 60 which leads to outer jacket spiral 62. As the vapor passes through spiral 62 it is heated by an inner radiant tube 63 and an outer radiant tube 65 which are heated by flame from the burner system. The steam then passes, as stated, through pressure switch 34 to steam supply line 38.

A pump 64 run by burner motor 18 pumps fuel through the motor shaft 67 of pump 64 to aspirator 68 into the center of generator 21 to heat the water vapor in the generator. Blower 66 introduces air through louvers 84 into the combustion area.

Louvers 84 cause the air from blower 66 and the fuel from aspirator 68 to mix and flow into the combustion area.

The action of the apirator 68 draws hot gases from the combustion area into the louver 84 area causing the fuel droplets to turn to gas by the heat of the hot gases so that the fuel when burned is a gas. This allows more oxygen to mix with the gaseous fuel causing complete combustion not attainable with liquid fuel droplets.

Burner exhaust leaves the generator through exhaust 80. A pressure relief valve 82 is provided in the event the steam pressure gets abnormally high in the generator 21.

A fan 70 run by motor 32 through axle 72 and a belt 74 cools the condenser to condense the steam to water returning to hot well 44. An alternator 76 is operated by motor 32 through axle 72 and a belt 78 to provide electrical energy for the electrical system.

Referring now to FIGS. 4, 5, 6, and 7 there is shown the steam motor portion of the system. The motor is encased in an outer shell 86 cylinderical in shape. Multiple rotor blades or vanes 88, 90, 92, which may vary in number depending upon the particular design, rotate by steam pressure between rotating cylinder 94 and rotating disc 96. Said rotor blades 88, 90, 92 are slidingly engaged in a rotating carrier 98, said blades 88, 90, 92 being able to slide in a direction perpendicular to the outer circumference of carrier 98.

The disc 96 causes the rotor blades 88, 90, 92 to remain in contact with rotating cylinder 94 at all times.

A pin 97 in carrier 98 engages in a slot in the rotating cylinder 94 causing cylinder 94 to rotate together with carrier 98. As the carrier 98 rotates, pin 97 slides in and out of the slot in the rotary cylinder 94 because the relationship between the carrier 98 and cylinder 94 changes during rotation.

As the steam from the generator 21 via steam supply line 38 and after passing through throttle valve 12 and four-way reverse valve 14 enters the motor through an entrance port 100, the steam forces rotor 90, as shown, in a clockwise rotation until the steam reaches an outlet port 102 at which time the steam is returned to the surge tank 40.

Wheels (not shown) are mounted on motor shaft 120 which is fixedly attached to carrier 98, thus rotating as the steam rotates carrier 98 by forcing the rotor blades 88, 90, 92 in a clockwise direction. The wheels can be operated in the reverse direction by changing the position of four-way reverse valve 14 which causes the steam to enter the motor by port 102 and exit by port 100 causing the rotor blades 88, 90, 92 to rotate counter-clockwise.

Closing the throttle valve 12 will cause the motor to build up pressure and brake the rotation of the rotor blades, thus braking the wheels.

The motor assembly of the rotating cylinder 94, the rotor blades or vanes 88, 90, 92 and the disc 96 rotate as a unit around one center. The shaft 120 and carrier 98 rotate around another center. This causes the blades 88, 90, 92 to slide in and out of the carrier 98 exposing the blades to be forced in a circular pattern by steam pressure and retracting into the carrier 98 on the opposite side leaving no space for steam to leak which would cause steam pressure in the opposite direction.

The shaft 120 rotates with a minimum of friction within outer shell 86 due to roller bearings 104, 106, 108 and 110.

Carrier 98 and outer shell 86 are held in position by thrust bearings 112, 114, 116 and 118.

Figure 6:
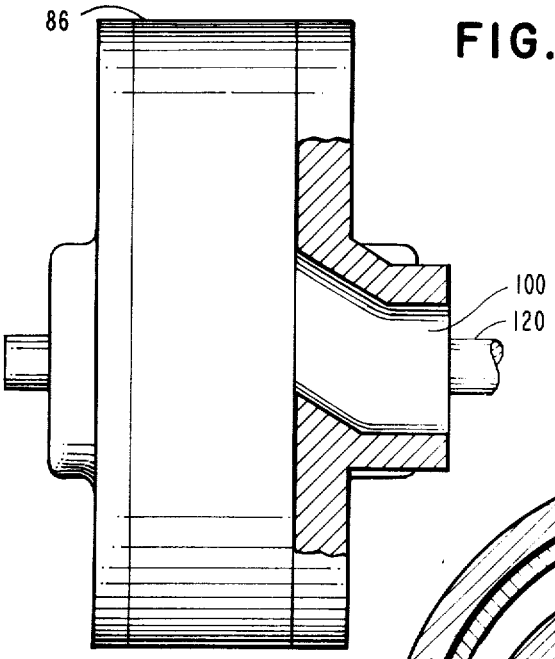
FIG. 6 is a side elevation partially broken away on lines 6—6 of FIG. 5.

Referring now to FIG. 6 there is shown the outer shell 86, shaft 120 and the inlet port 100 for the steam.

Figure 7:
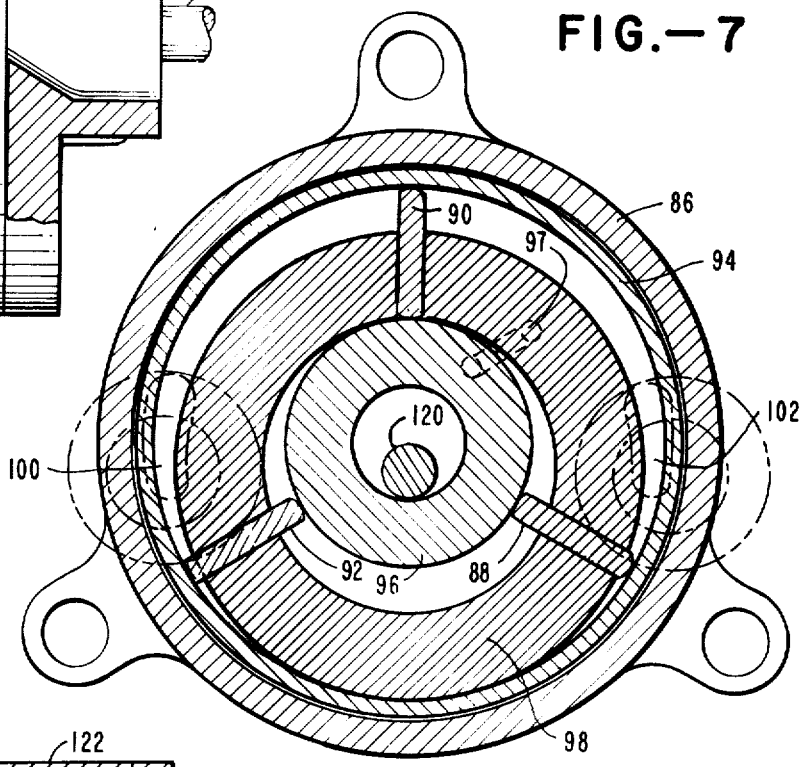
FIG. 7 is a cross-sectional view along the same lines as FIG. 5 but showing the motor turned 60 degrees.

FIG. 7 shows the motor with the rotor blades turned 60 degrees to show the release of the steam through exit port 102.

Figure 8:
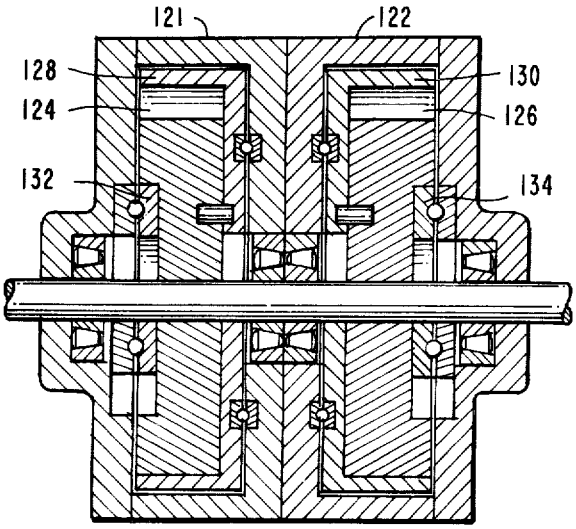
FIG. 8 is a cross-sectional view through the central axis showing a back-to-back arrangement of the water motor and pump assembly.

FIG. 8 shows the back-to-back arrangement of the motor and water pump assembly of this invention showing the outer shells 120 and 122. Rotor blades 124 and 126 rotate between rotary cylinders 128 and 130 and discs 132 and 134.

A back-to-back arrangement as described is utilized to provide the steam motor-pump arrangement 30, 32 used in the generator stage of this system. The steam motor must be larger than the water pump portion to provide greater pressure to force water vapor into the generator.

Many of the individual parts required to construct the system of the present invention are well known are are available commercially, for instance fog nozzles as described are availabe in a variety of types such as those manufactured by Bette and the burner motor and pump assembly is standard, manufactured by large pump manufacturers.

The system can be totally lubricated and anti-freeze protection provided by the addition of a silicone compound which travels through the system constantly with the steam. The rotary cylinder motor mounts in and drives each wheel, thus braking power is provided by action of the motor itself. The motor is practically friction-free with positive displacement and is so powerful it does not require gearing down to start the car, for instance.

The oil burner, furnishing the heat to make the steam, changes the fuel to gas and can burn jet fuel, light deisel oil, gasoline or any distillate without making smog.

In operation, one horsepower will require about 2545 BTU. One pound of fuel will generate about 19,000 BTU, one gallon (about eight pounds) about 152,000 BTU. Six gallons will generate about 912,000 BTU equalling 360 horsepower.

Having thus described the invention, I claim:

1. A rotary cylinder positive displacement motor comprising:

a. an outer cylinderical shell
b. an inner rotating cylinder
c. a carrier adapted to receive
d. rotor blades which slide in said carrier
e. a rotating disc to position said rotor blades
f. a motor shaft rotatably mounted on roller bearings attached to said carrier
g. ports for the introduction and release of steam adapted to cause said rotors to rotate within said outer shell
h. a thrust bearing assembly interconnecting said outer shell and said cylinder
i. a second thrust bearing assembly interconnecting said disc and said outer shell

2. A rotary cylinder positive displacement motor comprising, an outer cylindrical shell having first and second ports and closed ends, each end having an aperture eccentric to the axis of the cylindrical shell, a cylinder having one closed end with a central aperture therein, said cylinder being concentrically mounted in said second outer cylindrical shell for rotation, the outer periphery of said cylinder being spaced from the inner periphery of said second outer shell, a thrust bearing assembly interconnecting the first of said closed ends of said second shell and the closed end of said cylinder, a shaft rotatably mounted on roller bearings in the eccentric apertures of said second outer shell and passing through the central aperture in said cylinder, a carrier fixedly mounted concentrically to said shaft, said carrier having a plurality of radial slots therein, an annular disc surrounding said shaft and having a second thrust bearing assembly interconnecting said disc and the second closed end of said second outer shell, said disc being concentric to said cylinder, a plurality of vanes being slidably supported in each of said plurality of slots, each of said vanes having a first end in contacting relationship with the outer periphery of said annular disc and a second end in contacting relationship with the inner periphery of said cylinder.

3. The motor of claim 2 including means for loosely connecting said cylinder and said carrier.

* * * * *